US011015908B2

(12) United States Patent
Sloff et al.

(10) Patent No.: US 11,015,908 B2
(45) Date of Patent: May 25, 2021

(54) METHOD OF MAKING A BULLET COMPRISING A COMPACTED MIXTURE OF COPPER POWDER

(71) Applicant: SinterFire, Inc., Kersey, PA (US)

(72) Inventors: Michael Sloff, Saint Marys, PA (US); Brian Benini, Kersey, PA (US); Kevin Geist, Dubois, PA (US)

( * ) Notice: Subject to any disclaimer, the term of this patent is extended or adjusted under 35 U.S.C. 154(b) by 0 days.

(21) Appl. No.: 16/394,630

(22) Filed: Apr. 25, 2019

(65) Prior Publication Data

US 2020/0088502 A1 Mar. 19, 2020

Related U.S. Application Data

(62) Division of application No. 15/406,003, filed on Jan. 13, 2017, now Pat. No. 10,309,756.

(60) Provisional application No. 62/431,818, filed on Dec. 8, 2016, provisional application No. 62/280,936, filed on Jan. 20, 2016.

(51) Int. Cl.

| | |
|---|---|
| ***F42B 12/74*** | (2006.01) |
| ***F42B 5/02*** | (2006.01) |
| ***F42B 12/36*** | (2006.01) |

(52) U.S. Cl.

CPC ..... *F42B 12/74* (2013.01); *F42B 5/02* (2013.01); *F42B 12/367* (2013.01)

(58) Field of Classification Search

CPC ..... F42B 12/10; F42B 12/34; F42B 12/72; F42B 12/74; F42B 5/02; F42B 12/367

See application file for complete search history.

(56) References Cited

U.S. PATENT DOCUMENTS

| | | | | |
|---|---|---|---|---|
| 4,836,108 | A | 6/1989 | Kegel | |
| 6,074,454 | A | 6/2000 | Abrams et al. | |
| 6,485,540 | B1 * | 11/2002 | Kosco | C22C 33/02 419/29 |
| 6,536,352 | B1 * | 3/2003 | Nadkarni | B22F 1/0003 102/506 |
| 8,312,815 | B1 * | 11/2012 | Joys | C22C 1/0425 102/506 |
| 9,188,416 | B1 | 11/2015 | Hash | |
| 2011/0162550 | A1 | 7/2011 | Hash et al. | |
| 2014/0326155 | A1 * | 11/2014 | Smith | F42B 12/02 102/439 |

(Continued)

FOREIGN PATENT DOCUMENTS

| | | | |
|---|---|---|---|
| CA | 2786331 A1 * | 7/2011 | F42B 12/367 |
| WO | WO 96/32439 | 10/1996 | |

OTHER PUBLICATIONS

International Search Report of PCT/US2017/013438 issued from European Patent Office and dated Apr. 6, 2017.

*Primary Examiner* — Stephen Johnson
(74) *Attorney, Agent, or Firm* — Finnegan, Henderson, Farabow, Garrett & Dunner, LLP

(57) ABSTRACT

A bullet comprising a compacted mixture of copper powder comprising particles that are physically bonded to each other to form a cohesive and ductile microstructure is disclosed. Methods of making such a bullet through powdered metallurgy techniques, which provide sufficient properties to allow the bullet to be loaded into a cartridge and crimped without fracture are also disclosed. Such bullets have sufficient strength to maintain their integrity during firing but may fragment upon impact and can be formulated lead-free.

10 Claims, 3 Drawing Sheets

(56) References Cited

U.S. PATENT DOCUMENTS

2017/0219325 A1* 8/2017 Smith ..... F42B 12/74

* cited by examiner

200

201

METHOD OF MAKING A BULLET COMPRISING A COMPACTED MIXTURE OF COPPER POWDER

This applications claims benefit of priority of U.S. Provisional Application No. 62/280,936, filed on Jan. 20, 2016, and 62/431,818, filed on Dec. 8, 2016, both of which are incorporated herein by reference in their entireties. This application is a divisional of U.S. patent application Ser. No. 15/406,003, filed on Jan. 13, 2017, now U.S. Pat. No. 10,309,756.

TECHNICAL FIELD

The present disclosure relates generally to a bullet comprising a compacted mixture of copper powder. The present disclosure also relates to methods of making and a cartridge containing such a bullet.

BACKGROUND

Compressed powder metal bullets are bullets comprised of powdered metal that are made using powdered metallurgy techniques. Such techniques include compressing powdered metal to form a green solid, then subsequently heat treating to obtain a desired metallurgical strength. These bullets can then be jacketed, plated or made to size in a centerfire or rimfire cartridge. Bullets made from compressed metal powder can be made "frangible" by altering the process to achieve a brittle microstructure. Such bullets are characterized by the use of metal powder consolidated into a bullet that has sufficient strength to maintain its integrity during firing while fragmenting on impact with a solid object.

Unlike, conventional, full-density, cast, swaged, copper plated or copper jacketed lead bullets, frangible bullets protect the shooter from ricochets. For this reason, the walls of traditional shooting ranges were often covered with a projectile absorbing material, such as rubber. In addition, shooting lead bullets necessarily causes the emission of airborne lead dust, which not only requires the implementation of elaborate ventilation systems in shooting ranges, but the proper disposal of spent lead bullets and bullet fragments. Government regulations on the use and exposure to lead are making it a banned element in bullets. Recently, the state of California has banned hunters from using lead bullets.

In view of these problems, there has been a long-standing search for a material to use as a bullet that does not contain lead and does not ricochet. One problem in replacing lead in ammunition is that the replacement material must be sufficiently heavy such that ammunition using such bullets, when used in automatic or semi-automatic weapons, will be able to cycle the weapon properly. Further, a lead-free, training round should break up into small particles when it hits a hard surface, such as when used for low costs "plinking" rounds. The individual particles are then too light to carry enough energy to be dangerous.

One problem associated with the use of frangible bullets is that typically do not exhibit appropriate ductility for use in large scale manufacturing. Traditional powdered metal projectiles are too brittle to withstand the forces that allow them to be loaded and crimped into a cartridge and subsequently chambered, fired and ejected from a rifle corresponding to its caliber.

The disclosed bullet is directed to overcoming one or more of the problems set forth above and/or other problems of the prior art, specifically providing beneficial ductility properties that allow it to withstand crimping and high volume production using existing capital and tooling.

SUMMARY

In one aspect, the present disclosure is directed to a bullet formed with a base material of pure copper powder in which the copper powder particles are partially sintered, and physically bonded to each other to form a cohesive and ductile microstructure.

In another aspect, the present disclosure is directed to a method of making a bullet having the steps of pressing copper powder in a mold to form a green compact. The method further comprises heating the green compact to a temperature that partially sinters the copper particles to achieve physical bonding of the copper particles to form a consolidated compact. This method results in a copper bullet having a cohesive microstructure.

In yet another aspect, the present disclosure is directed to a cartridge which includes a metal cartridge case, a primer, a propellant within the cartridge case, and a bullet comprised of a compacted mixture of partially sintered copper powder described herein.

Aside from the subject matter discussed above, the present disclosure includes a number of other features such as those explained hereinafter. Both the foregoing description and the following description are exemplary only

DETAILED DESCRIPTION

Description of the Bullet

In accordance with the present disclosure, a metal bullet, such as a copper bullet, is provided as described and claimed herein. In one embodiment, there is disclosed a lead-free bullet comprising a compacted mixture of copper powder, wherein the copper powder comprises particles that are physically bonded to each other to form a cohesive and ductile microstructure. A cohesive and ductile microstructure allows for crimping and rifling. While the copper powder particles can be sintered, alternative or additional embodiments include copper powder particles that are bonded by pre-sintering or partial sintering. This ability to vary the bond strength between particles from sintered to pre-sintered states allows for flexibility in the frangibility properties of the resulting bullet. As used herein, "partial sintering" or "pre-sintering" is intended to mean that some neck growth has developed between particles; however, porosity remains between adjacent particles.

In one embodiment, the physical bond between the copper powder particles generally comprises metallic bonds.

In an embodiment the copper powder can be mixed with at least one additional metal powder comprising an alloy of copper. When alloying elements are present, the resulting bullet may comprise intermetallic alloys (also simply referred to as "intermetallics") of the various alloying elements. Examples of such alloying elements that can be included in addition to copper are iron, nickel, chromium, tin, zinc, and their alloys, and intermetallic compounds of these metals. Non-limiting examples of alloys that can be used in addition to copper powder are brass, bronze, and combinations thereof. In one embodiment the copper powder includes a sintering aid. In another embodiment the sintering aid is phosphorous or boron.

In another embodiment the bullet is comprised of pure copper, and thus is substantially free of intermetallics. As used herein, "pure copper" is intended to mean at least 98.50% by weight copper. Whether containing pure copper or additional alloying elements, the bullet described herein generally exhibits a density ranging from 7.0 to 8.2 g/cc, such as from 7.2 to 8.2 g/cc, from 7.5 to 8.2 g/cc, or even from 7.8 to 8.2 g/cc. Pistol products typically have ranges less than 7.6 g/cc while rifle and rimfire products typically have ranges greater than 7.6 g/cc up to 8.2 g/cc.

In an embodiment the bullet may comprise an admixed lubricant that aids in processing, primarily in the pressing steps that allows in ease of pressing and release from the mold. Non-limiting examples of the lubricant that can be used include molybdenum disulfide, zinc stearate, lithium stearate, carbon, synthetic wax, such as N,N' Ethylene Bis-Stearamide or N,N' Distearoylethylenediamine (sold as Acrawax® by Lonza), polytetrafluoroethylene (sold as Teflon® by DuPont Co.), polyethylene, polyamide, and polyvinyl alcohol, and combinations of any of the foregoing.

Figure 1A:
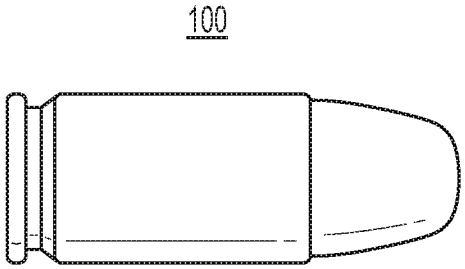
FIG. 1A is a photograph of a pistol cartridge and FIG. 1B is a representation of a bullet used in the cartridge of FIG. 1A.
Figure 1B:
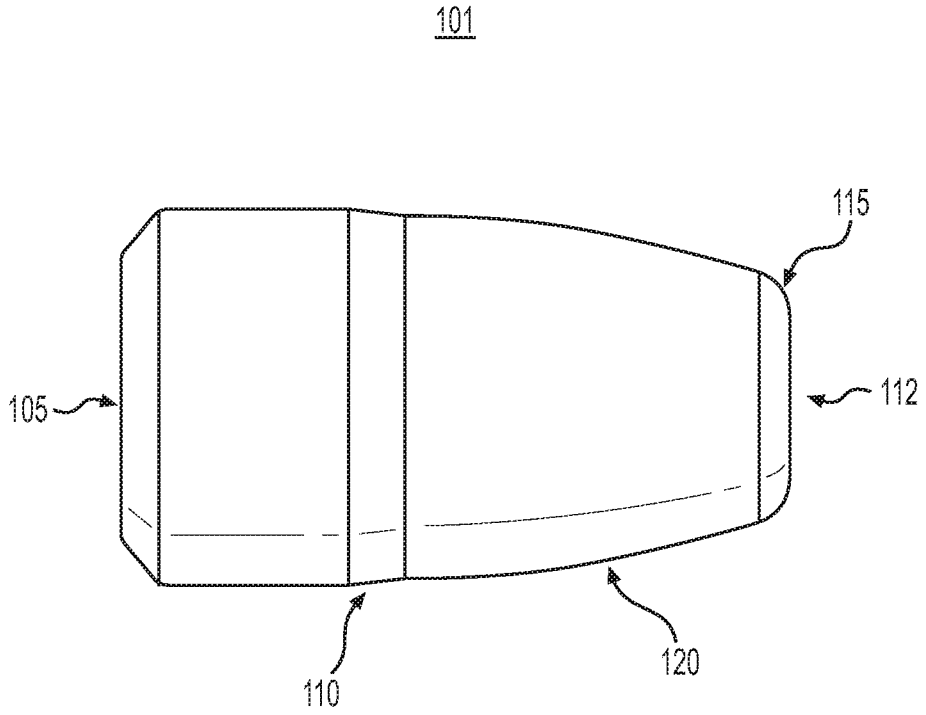

In one embodiment, the bullet described herein is used in a pistol product. To exemplify this product, reference is made to FIGS. 1A (100) and 1B (101). Focusing on FIG. 1B, there is shown pistol product (101) comprising a heel or base (105), a driving band (110), and a nose portion (112), which comprises a meplat (115), which is the tip portion of the nose, and an ogive (120), which is the radius portion that connects the body to the bullet nose.

Figure 2A:
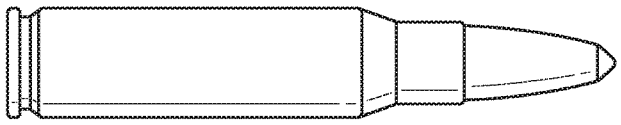
FIG. 2A is a photograph of a rifle cartridge and FIG. 2B is a representation of a bullet used in the cartridge of FIG. 2A.
Figure 2B:
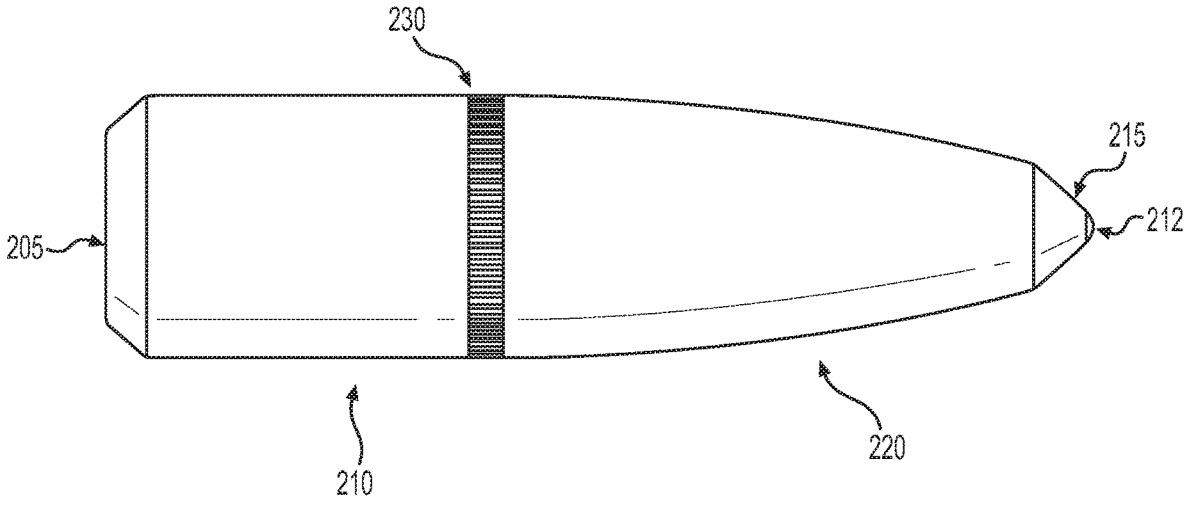

In one embodiment, the bullet described herein is used in a rifle product. To exemplify this product, reference is made to FIGS. 2A (200) and 2B (201). Focusing on FIG. 2B, there is shown rifle product (201) comprising a heel or base (205), a driving band (210), and a nose portion (212), which comprises a meplat (215), which is the tip portion of the nose, and an ogive (220), which is the radius portion that connects the body to the bullet nose. In one embodiment, an optional knurled cannelure, as shown in FIG. 2B (230), may be added to the bullet. The ability to add a cannelure is a function of the ductile nature of the bullet made according to this disclosure.

Description of the Method

An additional embodiment of this disclosure is directed towards a method of making a bullet comprising, pressing copper powder in a mold to form a green compact. Pressing is generally performed to achieve a uniform density ranging from 7.0 to 8.2 g/cc, such as from 7.2 to 8.2 g/cc, from 7.5 to 8.2 g/cc, or from 7.8 to 8.2 g/cc. Pistol products typically have ranges less than 7.6 g/cc while rifle and rimfire products typically have ranges greater than 7.6 g/cc up to 8.2 g/cc.

Next, the process includes heating the green compact to below the melting point of copper to achieve physical bonding of the copper particles in the green compact, and to form a copper bullet comprising cohesive microstructure. Heat treating typically occurs below the melting point of copper, and in some cases, below the sintering temperature of copper. For example, non-limiting temperature ranges which may be used in the described method include from 1200° F. to 1600° F., such as from 1250° F. to 1450° F., or from 1350° F. to 1450° F. Heat treating may occur in a reducing atmosphere, such as in $N_2$, for a time sufficient to achieve desired metallurgical properties. Such times typically range from 15 to 90 minutes, such as 20 to 60 minutes, with 20 to 40 minutes being noted as useful. In various embodiments, the heat treating step is performed in reducing atmosphere. For example, in non-limiting embodiments the reducing atmosphere may comprise any oxygen reducing gas, such as hydrogen (e.g., $H_2$), nitrogen, or carbon monoxide. Pistol products typically have ranges from 1,250 to 1,450° F., such as from 1300° F. to 1400° F. with time at temperature from 20 to 50 minutes. In contrast, rifle and rimfire products have ranges from 1,300 to 1,450° F., such as 1350° F. to 1450° F. with time at temperature from 60 to 90 minutes.

The described method may include treating the surface of the copper bullet by performing at least one tumbling process, which might by dry or wet tumbling. For example, in one embodiment, the method may include tumbling of finished bullets together followed by or instead of a dry tumbling process using an additional media, such as corn cob, walnut, stainless steel, and combinations thereof. These tumbling steps may each occur for a time sufficient to remove scale and bring the heel of the bullet into size, as well as burnish the surface to remove burrs and to generally improve surface appearance. Such times typically range from 5 to 60 minutes, with 15 to 30 minutes being noted as useful.

INDUSTRIAL APPLICABILITY

The disclosed copper bullet comprising a compacted mixture of partially sintered particles that are physically bonded to each other, and method of making it are applicable to the making loaded ammunition, such as a rifle cartridge, including a 22 caliber cartridge or a 223 caliber or any pistol/rifle cartridge, a 5.56 caliber rifle cartridge, or a 7.62 caliber cartridge. In another embodiment said rifle cartridge is a rimfire cartridge or a centerfire cartridge.

Figure 3:
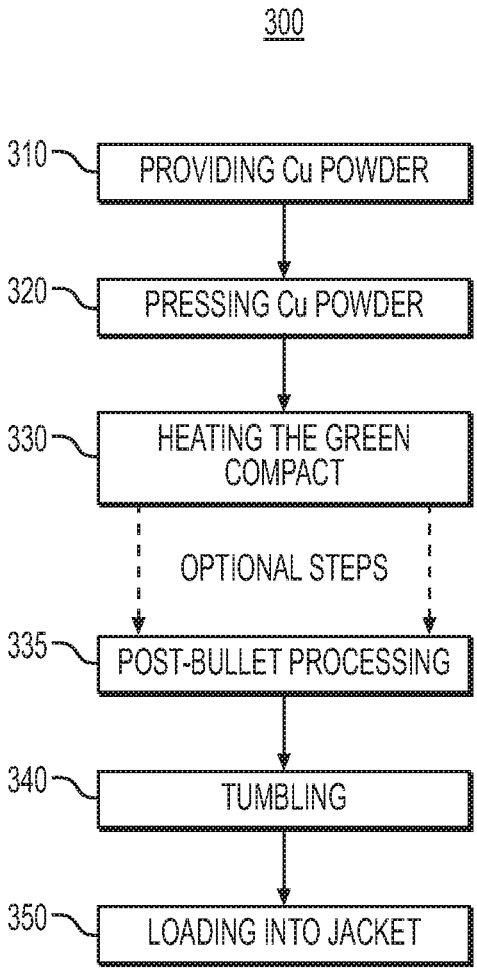
FIG. 3 is a flow chart illustrating steps of an embodiment of a method of making a bullet as described herein.

The disclosed method is described with reference to FIG. 3. Here the particular steps of an embodiment of a method 300 for preparing a bullet as disclosed are shown. The bullet is produced from a copper powder following principles of the present disclosure. For example, the required copper powder is provided, and optionally mixed with a lubricant, examples of which were previously described (step 310).

The powder is then pressed which is compacted, under pressure using known compacting techniques, such as die compaction, rotary screw compaction, isostatic pressing, to form a shaped green compact of uniform density (step 320). In an embodiment, the compacting step is performed at room temperature, which may be referred to as "cold compaction." In another embodiment, the compacting step is performed under heating conditions. In this embodiment, the powder is heated before pressure is applied to the material. It is understood that this heating step is done at a temperature that does not adversely affect other components present in the powder, such as the previously described lubricants. Alternatively, the heating step is performed at a high enough temperature that allows for sufficient compaction with a reduced amount of lubricant.

The green compact is then heat treated at a temperature below the melting point of copper, and in some embodiments, below the sintering point of copper (step 330). Other optional processing steps that can be performed on the bullet described herein. For example, in various embodiments, the bullet can be processed to include one or more cannelure grooves, a tipped point, a hollow point, boat-tailed, a ring (multiple groves), and combinations thereof (step 335), OD size qualification, nose markers, customer specific requirements, etc.

The heat treated bullet can then be exposed to multiple optional processing steps, including one or more tumbling steps to affect the surface (step 340). In addition, the bullet can be loaded into a casing, such as a brass casing, to make ammunition of various calibers (step 350). A more detailed discussion of the cartridge is provided below.

Description of the Cartridge

As indicated, in one embodiment, the disclosed copper bullet can be loaded in a cartridge. A conventional centerfire cartridge can be used with the disclosed bullet, however, a rimfire cartridge can also be used for pistol and rifle rounds. For example, the disclosed bullet can be inserted in the case mouth, which can then be crimped to assist in retaining the bullet at the desired depth of insertion. The bullet described herein has sufficient strength and ductility to withstand the crimping operation without fracturing during crimping.

In an embodiment, the case further includes a primer pocket into which a separate primer can be inserted. As mentioned, the case can be a straight walled case typical of pistol ammunition. Alternatively, bullets described herein are also useful as rifle ammunition and for such ammunition the case may be a "bottle necked" cartridge, with the case mouth having a diameter less than the body of the cartridge case.

In an embodiment, the propellant (gun powder) can be placed in the body of the cartridge case. In an embodiment, the primer, like the bullet, is lead-free. However, it is understood that any conventional primer may be used. The described cartridge may comprise a metal cartridge case, a primer, a propellant within said cartridge case, a bullet comprising a compacted mixture of copper powder, wherein the copper powder comprises particles that are physically bonded to each other to form a cohesive microstructure.

The bullet disclosed herein exhibits characteristics sufficient to withstand circumferential crimping. For example, the disclosed bullet exhibits density and malleability properties that allow it to be loaded into a cartridge and crimped. Such properties include a density ranging from 7.0 to 8.2 g/cc, and metallic bonds between a majority of the copper powder particles in the bullet.

In one embodiment, the resulting loaded bullet has a pull-out force ranging from 25 to 50 lbs, such as from 30 to 50 lbs, 35 to 50 or even 40 to 50 lbs. of pull-out force for a pistol bullet. The pull-put force for a rifle cartridge is typically twice that of a pistol bullet, often being over 100 lbs.

In various embodiments, the resulting loaded cartridge is a rimfire or center fire cartridge. Non-limiting embodiments of rifle cartridges that can be made according to the present disclosure include the following calibers: 0.22, including a 0.22 long rifle, 0.223, 0.308, 0.338, or any pistol/rifle cartridge. In addition, 5.56 mm, 7.62 mm rifle cartridges can be produced according to the present disclosure.

EXAMPLES

The following non-limiting examples are intended to be exemplary, and are provided to further clarify the present disclosure.

Example 1

Copper bullets according to the present disclosure were formed in the following manner. With reference to FIG. 3, commercial copper powder described in Table 1 (Atomized Copper Powder per MPIF Standard 35, material grade C-0000) was mixed with a lithium stearate (Step 310). The lubricant assisted in compaction and ejection of the green compact and was substantially removed during subsequent heat treatment. The premix had particle sizes ranging from less than 45 μm to greater than 125 μm, with particles sieved through a nominal 150 mesh (<105 μm). The mixture was compacted using a standard shelf die in a mechanical press at a compaction pressure ranging from 35 to 55 tons per square inch (tsi), to achieve a pressed copper powder having a uniform density of about 8.0 g/cc (Step 320). Next, the green compact was heat treat in a dry $N_2$ atmosphere for 30 minutes at 1600° F. to form molded parts (Step 330). The molded parts were dry tumbled part-on-part for 30 minutes (Step 340). This dry tumble step is optional.

TABLE 1

| Chemical/Physical Properties | Specification |
|---|---|
| Total Copper, % | 99.50 min. |
| Hydrogen Loss, % | 0.25 max. |
| Acid Insolubles, % | 0.05 max. |
| Iron, % | 0.05 max. |
| Lead, % | 0.05 max. |
| Zinc, % | — |
| Tin, % | — |
| Apparent Density, Hall, g/cm | 2.8 to 3.6 |
| Flow Rate, s/50 g | 30 max. |
| Sieve Analysis, USS, % | |
| +115 (>125 μm) | 0.2 max. |
| −115 +140 | 1.0 max. |
| −140 +200 | — |
| −200 +325 | — |
| −325 (<45 μm) | 50 to 70 |

Example 2

This Example describes a jacketed bullet to form a rifle cartridge. The bullet made in Example 1 were loaded into brass rifle cartridges and crimped. (Step 350). Projectiles will be ductile enough to withstand circumferential crimping forces imposed on it, once it is loaded into a cartridge, to achieve a minimum pull-out force of 30 lbs. The resulting ammunition was tested from several different weapons, including semi-automatic and bolt operated. The ammunition operated without malfunction, including feeding, firing and ejecting without problems.

Example 3

This Example describes a projectile according to the present disclosure that was prepared by blending 99% pure Copper powder with 0.375% Lithium Stearate lubricant. The powder and lubricant were blended to produce projectiles according to the present disclosure. Multiple lots were tested for apparent density and flow.

The average apparent density and flow of the lots are provided in Table 2. As shown, apparent density the average of these lots shows an apparent density of approximately 3.38 g/cc and a flow of 45 s/50 g. Multiple lots were tested for apparent density and flow. The results of this testing are provide in the Table 2.

TABLE 2

| Lot | Apparent Density (g/cc) | Flow (s/50 g) |
|---|---|---|
| 1 | 3.42 | 40 |
| 2 | 3.40 | 31 |
| 3 | 3.26 | 39 |
| 4 | 3.38 | 41 |
| 5 | 3.34 | 40 |
| 6 | 3.60 | 48 |
| 7 | 3.41 | 42 |
| 8 | 3.38 | 45 |

Next, the copper powder was pressed in both a conventional compaction press (20-ton Elmco) and a high-speed rotary tablet press (Elizabeth-Hata, 18-station) with cylindrical bullet-shaped tooling. The pressed projectile had a compacted density of 7.2 g/cc. Measurements of driving band diameter (see, for example, FIGS. 1B 101 and 2B at 201), overall length, weight and density were recorded. Thirty (30) samples were measured for further statistical analysis.

The green projectiles were then loaded onto a belt furnace 12 in. wide (11.5 in. useable) by 33 ft. long. A 6 ft. section of scrap parts was deployed before and after the projectiles to maintain a consistent furnace temperature. The belt furnace used had an inert atmosphere of 100% Nitrogen flowing at a total of 450 SCFH. The furnace had three heat zones set at 1400° F. and the belt speed was set for 4.8 inches per minute to give the parts 30 minutes in the heat zones.

It will be apparent to those skilled in the art that various modifications and variations can be made to the disclosed alloy and method of forming the alloy into a finished part without departing from the scope of the disclosure. Alternative implementations will be apparent to those skilled in the art from consideration of the specification and practice disclosed herein. It is intended that the specification and examples be considered as exemplary only, with a true scope of the disclosure being indicated by the following claims and their equivalents.

Other embodiments of the invention will be apparent to those skilled in the art from consideration of the specification and practice of the invention disclosed herein. It is intended that the specification and examples be considered as exemplary only, with the true scope of the invention being indicated by the following claims.

What is claimed is:

1. A method of making a bullet comprising:

pressing a single metal powder comprising at least 98.5% by weight of copper in a mold to form a green compact; and heating the green compact to a temperature that partially sinters the single metal powder to achieve physical bonding of copper particles and achieve a consolidated microstructure and to form a copper bullet comprising a cohesive microstructure, wherein heating the green compact is performed at a temperature ranging from 1300° F. to 1450° F.

2. The method of claim 1, further comprises treating the surface of the copper bullet by performing at least one tumbling process.

3. The method of claim 1, further comprising at least one step to introduce into the bullet at least one design chosen from a cannelure groove, a tipped point, a hollow point, boat-tail, ring, a grove, and combinations thereof.

4. The method of claim 1, further comprising at least one post processing step to size the copper bullet to achieve a desired diameter.

5. The method of claim 1, wherein the copper powder is pressed to a density ranging from 7.0 to 8.2 g/cc.

6. The method of claim 1, wherein the green compact is heated to a temperature ranging from 1350° F. to 1450° F.

7. The method of claim 1, wherein the green compact is heated to a temperature ranging from 1300° F. to 1400° F.

8. The method of claim 1, further comprising adding at least one lubricant to the single metal powder prior to pressing.

9. The method of claim 8, wherein said lubricant comprises molybdenum disulfide, lithium stearate, zinc stearate, carbon, synthetic wax, a polymer selected from polytetrafluoroethylene, polyethylene, polyamide, and polyvinyl alcohol, and combinations of any of the foregoing.

10. The method of claim 9, wherein the synthetic wax comprises N,N' Ethylene Bis-Stearamide or N,N' Distearoylethylenediamine.

* * * * *